US005894619A

United States Patent [19]

Hougland et al.

[11] Patent Number: 5,894,619

[45] Date of Patent: Apr. 20, 1999

[54] APPARATUS FOR CLEANING DENTURES

[76] Inventors: D. Wayne Hougland; Shell R. Hougland, both of 801 Beech, Canon City, Colo. 81212

[21] Appl. No.: 08/840,993

[22] Filed: Apr. 25, 1997

[51] Int. Cl.[6] ..... A46B 13/02

[52] U.S. Cl. ..... 15/21.1

[58] Field of Search ..... 15/21.1, 30, 34, 15/36, 77, 88, 74, 75, 76

[56] References Cited

U.S. PATENT DOCUMENTS

| | | | |
|---|---|---|---|
| 2,236,462 | 3/1941 | Binkley | 15/21.1 |
| 3,055,029 | 9/1962 | Maetzold | 15/21.1 |
| 3,332,099 | 7/1967 | Reiter | 15/21.1 |
| 3,774,256 | 11/1973 | Gauthier | 15/21.1 |
| 5,535,472 | 7/1996 | Miller | 15/21.1 |
| 5,742,965 | 4/1998 | Leask | 15/21.1 |

FOREIGN PATENT DOCUMENTS

| | | | |
|---|---|---|---|
| 765669 | 6/1934 | France | 15/36 |

*Primary Examiner*—Gary K. Graham

[57] ABSTRACT

An apparatus for cleaning dentures including a motor box and a cleaning unit. The cleaning unit is constructed with a rectangular configuration having a bottom face, a front face, a rear face, and a pair of end faces defining a closed interior space and a top opening. The cleaning unit further has a drive shaft coupled to the motor box and rotatably situated in apertures formed in the end faces of the cleaning unit. Such drive shaft is equipped with a drive gear coupled thereto within the interior space of the cleaning unit. Also included is a first brush assembly with a plurality of vertical brushes each having a dowel rotatably coupled between the end faces of the cleaning unit. The vertical brushes include gears for communicating with the drive gear of the drive shaft. Further, a plurality of bristles are coupled to the dowels of the vertical brushes and are radially extended therefrom. Further provided is a second brush assembly including a plurality of horizontal brushes each including a disk with a plurality of bristles extending outwardly therefrom. The second brush assembly is also equipped with gears for communicating with the drive gear of the drive shaft.

11 Claims, 5 Drawing Sheets

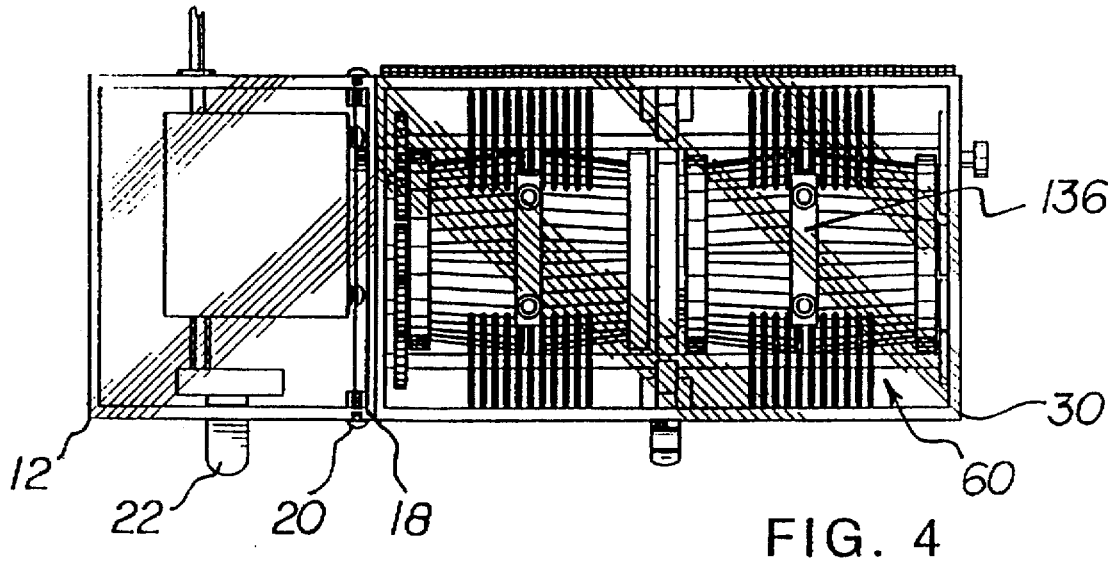
FIG. 4
FIG. 5
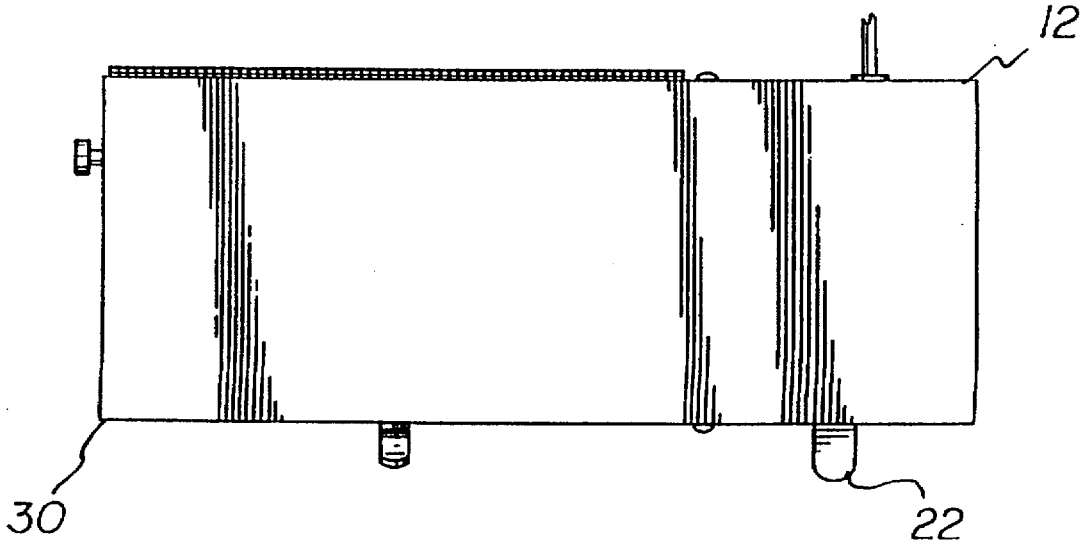

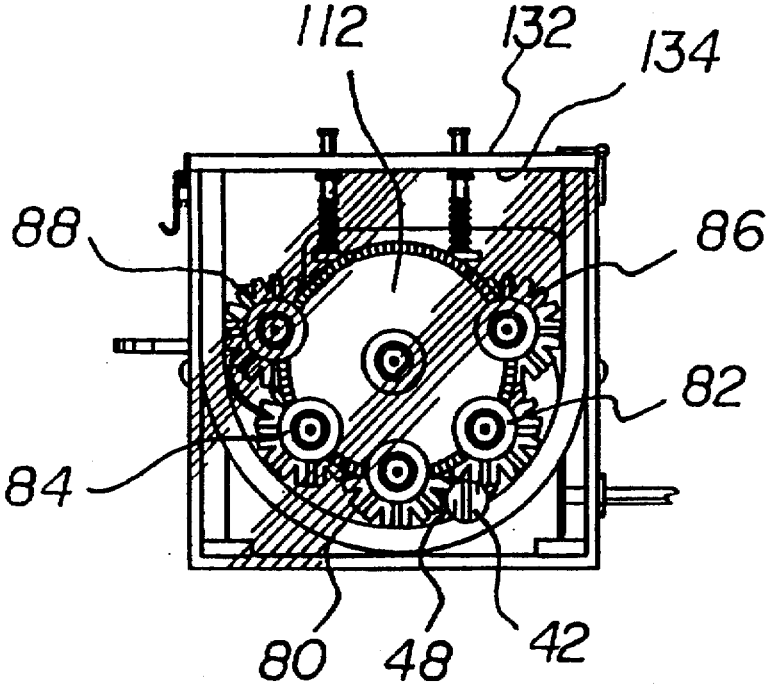
FIG. 6
FIG. 7
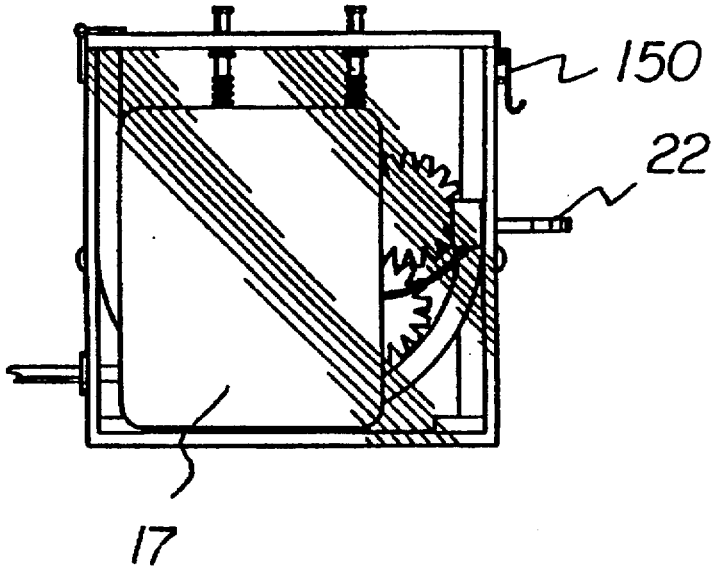

APPARATUS FOR CLEANING DENTURES

BACKGROUND OF THE INVENTION

1. Field of the Invention

The present invention relates to an apparatus for cleaning dentures and more particularly pertains to cleaning dentures with a plurality of various brushes.

2. Description of the Prior Art

The use of denture cleaners is known in the prior art. More specifically, denture cleaners heretofore devised and utilized for the purpose of cleaning dentures with various chemical compositions are known to consist basically of familiar, expected and obvious structural configurations, notwithstanding the myriad of designs encompassed by the crowded prior art which have been developed for the fulfillment of countless objectives and requirements.

In this respect, the apparatus for cleaning dentures according to the present invention substantially departs from the conventional concepts and designs of the prior art, and in so doing provides an apparatus primarily developed for the purpose of cleaning dentures with a plurality of various brushes.

Therefore, it can be appreciated that there exists a continuing need for a new and improved apparatus for cleaning dentures which can be used for cleaning dentures with a plurality of various brushes. In this regard, the present invention substantially fulfills this need.

SUMMARY OF THE INVENTION

In view of the foregoing disadvantages inherent in the known types of denture cleaners now present in the prior art, the present invention provides an improved apparatus for cleaning dentures. As such, the general purpose of the present invention, which will be described subsequently in greater detail, is to provide a new and improved apparatus for cleaning dentures which has all the advantages of the prior art and none of the disadvantages.

To attain this, the present invention essentially comprises a motor box with a rectangular configuration. As shown in FIG. 8, the motor box has an interface with a female gear mechanism rotatably coupled thereto and extending outwardly therefrom. The female gear mechanism is selectively driven by a motor situated within the motor box. The motor box further has a rectangular lip integrally formed with and extending outwardly from an entire periphery of the interface. It should be noted that the periphery extends outwardly a distance greater than that which the female gear mechanism extends. For reasons that will become apparent later, the motor box further has a pair of coupling screws screwably situated in threaded apertures formed in opposite sides of the lip. A timer mechanism is included as a component of the motor box for affording the driving of the female gear mechanism only for a predetermined amount of time. Further provided is a cleaning unit with a rectangular configuration having a bottom face, a front face, a rear face, and a pair of end faces defining a closed interior space and a top opening. The cleaning unit has a drive shaft rotatably situated in apertures formed in the end faces adjacent the bottom face and the rear face thereof. As shown in FIG. 8, the drive shaft has a male gear mechanism coupled to a first end thereof exterior of the cleaning unit. Such male gear mechanism is adapted for coupling with the female gear mechanism of the motor box. For allowing the coupling of the drive shaft with a drive shaft of another cleaning unit, a second female gear mechanism is coupled to a second end of the drive shaft opposite the male gear mechanism and exterior of the cleaning unit. A drive gear is coupled to the drive shaft adjacent the first end thereof and within the interior space of the cleaning unit. Note FIGS. 1 and 8. For allowing the selective coupling of the motor box and cleaning unit, a pair of tabs are provided extending from a first end face of the cleaning unit from which the male gear mechanism extends. Each tab has a threaded aperture formed therein whereby the cleaning unit may be situated in abutment with the motor box and the screws of the motor box threadedly coupled with the tabs for the relative securement thereof. As shown in the Figures, a first gear assembly is included with a plurality of vertical brushes each having a dowel rotatably coupled between the end faces of the cleaning unit. As can be seen in FIGS. 2–4 & 6, a gear is coupled to each dowel within the cleaning unit adjacent the first end face thereof. Each dowel has a first section of bristles radially extending from a portion thereof adjacent the first end face of the cleaning unit. A second section of bristles radially extends from a portion of each dowel adjacent a second end face of the cleaning unit. A space is situated between the first section of bristles and the second section of bristles. As can be best seen in FIG. 6, the plurality of vertical brushes include a first vertical brush centrally situated between a lower extent of the end faces with the gear thereof being in communication with the drive gear of the drive gear. Associated therewith is a second vertical brush situated above the first vertical brush on a first side thereof. The gear of the second vertical brush resides in communication with the gear of the first vertical brush. With reference still to FIG. 6, it can be seen that a third vertical brush is situated above the first vertical brush on a second side thereof with the gear of the third vertical brush being in communication with the gear of the first vertical brush. Still yet another vertical brush, the fourth vertical brush, is situated above the second and third vertical brushes between the second vertical brush and the rear face of the cleaning unit. The gear of the fourth vertical brush is maintained in communication with the gear of the second vertical brush. Finally, a fifth vertical brush is situated above the second and third vertical brushes between the third vertical brush and the front face of the cleaning unit with the gear thereof being in communication with the gear of the third vertical brush. By this structure, the vertical brushes rotate upon the rotation of the drive shaft. Further provided is a central vertical support plate centrally coupled within the interior space of the cleaning unit, as shown in FIG. 1. Such support plate is adapted for separating the interior space into two compartments. As can be seen in FIG. 1, the central vertical support plate has a pair of U-shaped cut outs formed in a bottom edge thereof for allowing the passage of the dowels of the vertical brushes therethrough. Also included is a second brush assembly. The second brush assembly includes a plurality of horizontal brushes each with a disk having a plurality of bristles extending outwardly from only one entire side thereof. As shown in FIGS. 1–4 & 8, the horizontal brushes include a first horizontal brush rotatably coupled to a central extent of the first end face of the cleaning unit with the bristles thereof facing inwardly. A periphery of the disk of the first horizontal brush has a plurality of teeth formed therein. Further included is a second horizontal brush rotatably coupled to a central extent of the second end face of the cleaning unit. The bristles of the second horizontal brush face inwardly with a periphery of the disk thereof having a plurality of teeth formed therein. A third horizontal brush is rotatably coupled to a central extent of the vertical central support plate with the bristles thereof facing toward the second horizontal brush. Similar to the prior disks, a periphery of the disk of the third horizontal brush has a plurality of teeth formed therein. Associated therewith is a fourth horizontal brush rotatably coupled to the central extent of the vertical central support plate and further coupled to the third horizontal brush for coincident rotation therewith. The bristles of the fourth horizontal brush face toward the first horizontal brush. In operation, a plurality of gears that are coaxially coupled along the length of the dowel of the first vertical brush are in communication with the teeth of the first, second, and third horizontal brushes. Such communication in turn effects rotation of the first, second, third, and fourth horizontal brushes upon the rotation thereof. Lastly, a lid is hingably coupled to the rear face of the cleaning unit adjacent the top opening thereof. The lid has a top surface and a bottom surface. As shown in FIG. 1, a pair of denture placement mechanism are coupled to the lid. Each denture placement mechanism includes a thin rectangular plate extending between a front and a rear edge of the lid. Such plates of the denture placement mechanisms further have a pair of posts coupled thereto for being slidably situated through apertures formed in the lid. For precluding the separation of the denture placement mechanisms from the lid, a knob is formed on a top end thereof. A plurality of springs are coaxially situated about each of the posts between the bottom surface of the lid and the associated plate. By this design upon the closing of the lid, the plates reside between the horizontal brushes for maintaining dentures between the brushes during the rotation thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved apparatus for cleaning dentures which has all the advantages of the prior art denture cleaners and none of the disadvantages.

It is another object of the present invention to provide a new and improved apparatus for cleaning dentures which may be easily and efficiently manufactured and marketed.

It is a further object of the present invention to provide a new and improved apparatus for cleaning dentures which is of a durable and reliable construction.

An even further object of the present invention is to provide a new and improved apparatus for cleaning dentures which is susceptible of a low cost of manufacture with regard to both materials and labor, and which accordingly is then susceptible of low prices of sale to the consuming public, thereby making such apparatus for cleaning dentures economically available to the buying public.

Still yet another object of the present invention is to provide a new and improved apparatus for cleaning dentures which provides in the apparatuses and methods of the prior art some of the advantages thereof, while simultaneously overcoming some of the disadvantages normally associated therewith.

Still another object of the present invention is to clean dentures with a plurality of various brushes.

Lastly, it is an object of the present invention to provide a new and improved apparatus for cleaning dentures including a motor box and a cleaning unit. The cleaning unit is constructed with a rectangular configuration having a bottom face, a front face, a rear face, and a pair of end faces defining a closed interior space and a top opening. The cleaning unit further has a drive shaft coupled to the motor box and rotatably situated in apertures formed in the end faces of the cleaning unit. Such drive shaft is equipped with a drive gear coupled thereto within the interior space of the cleaning unit. Also included is a first gear assembly with a plurality of vertical brushes each having a dowel rotatably coupled between the end faces of the cleaning unit. The vertical brushes include gears for communicating with the drive gear of the drive shaft. Further, a plurality of bristles are coupled to the dowels of the vertical brushes and are radially extended therefrom. Further provided is a second brush assembly including a plurality of horizontal brushes each including a disk with a plurality of bristles extending outwardly therefrom. The second brush assembly is also equipped with gears for communicating with the drive gear of the drive shaft.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a top view of the present invention with the lid in place.

FIG. 5 is a bottom view of the present invention.

FIG. 6 is a side view of the present invention depicting the second end face opposite the motor box.

FIG. 7 is a side view of the present invention depicting the first end face.

Similar reference characters refer to similar parts throughout the several views of the drawings.

DESCRIPTION OF THE PREFERRED EMBODIMENT

Figure 1:
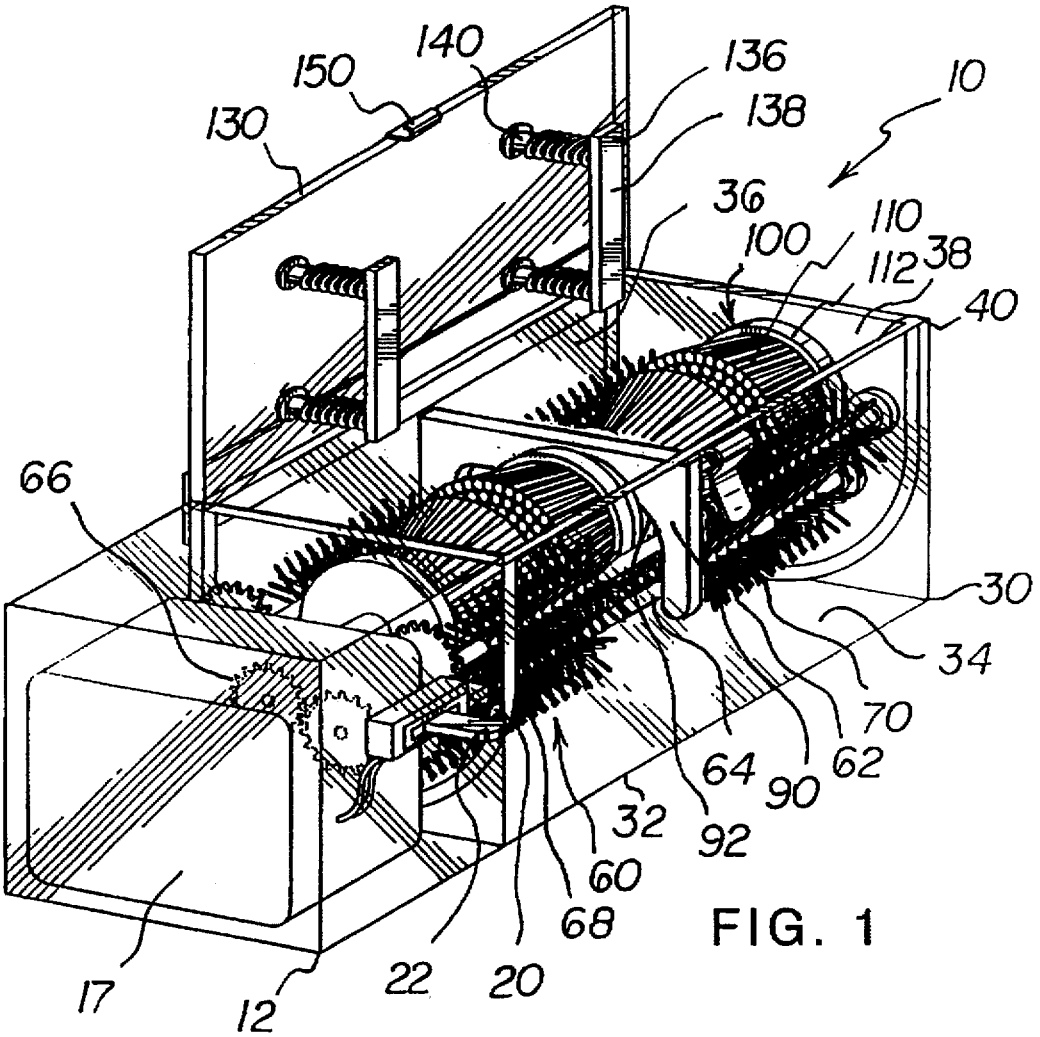
FIG. 1 is a perspective illustration of the preferred embodiment of the apparatus for cleaning dentures constructed in accordance with the principles of the present invention.
Figure 2:
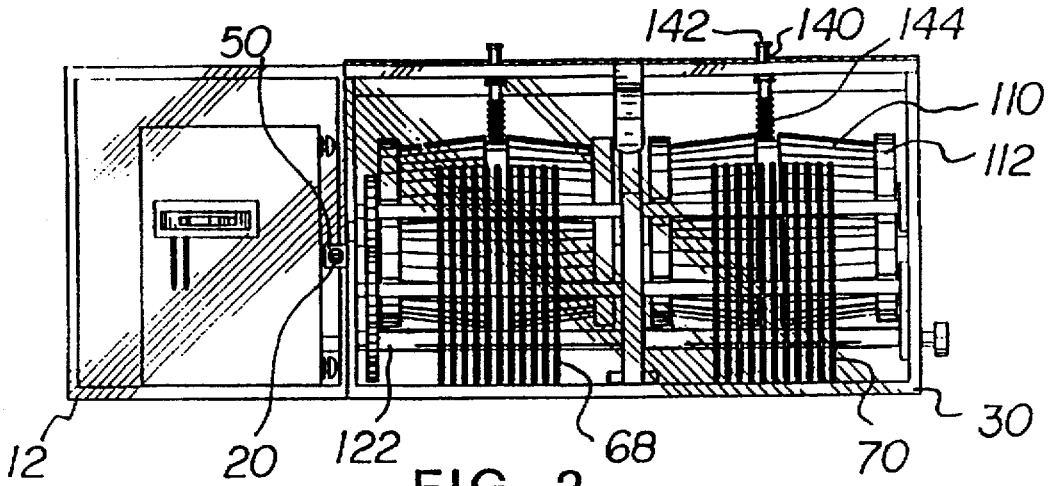
FIG. 2 is a front view of the present invention.
Figure 3:
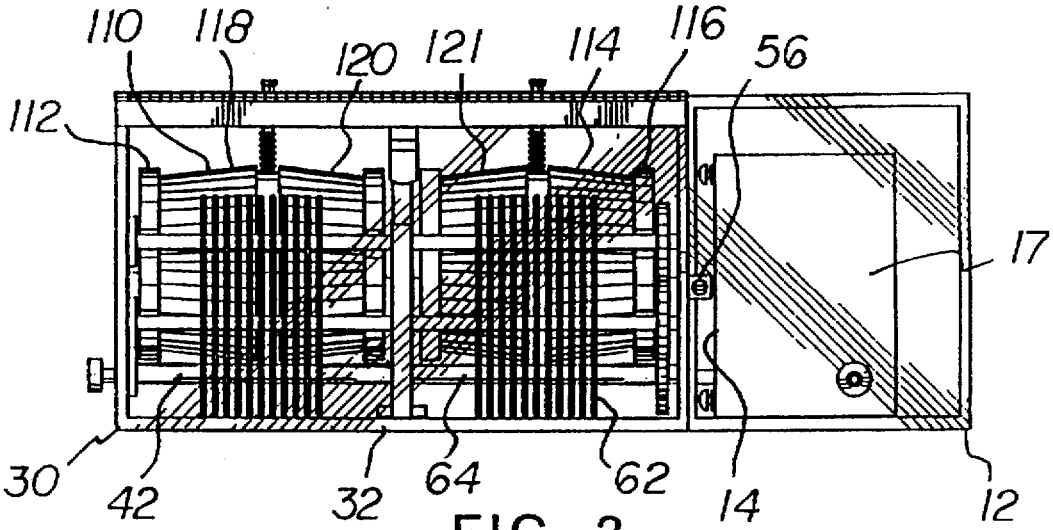
FIG. 3 is a rear view of the present invention.

With reference now to the drawings, and in particular to FIG. 1 thereof, a new and improved apparatus for cleaning dentures embodying the principles and concepts of the present invention and generally designated by the reference numeral 10 will be described.

The present invention, the new and improved apparatus for cleaning dentures, is comprised of a plurality of components. Such components in their broadest context include a motor box, cleaning unit, first brush assembly, vertical support second brush assembly, and lid. Such components are individually configured and correlated with respect to each other so as to attain the desired objective.

Figure 8:
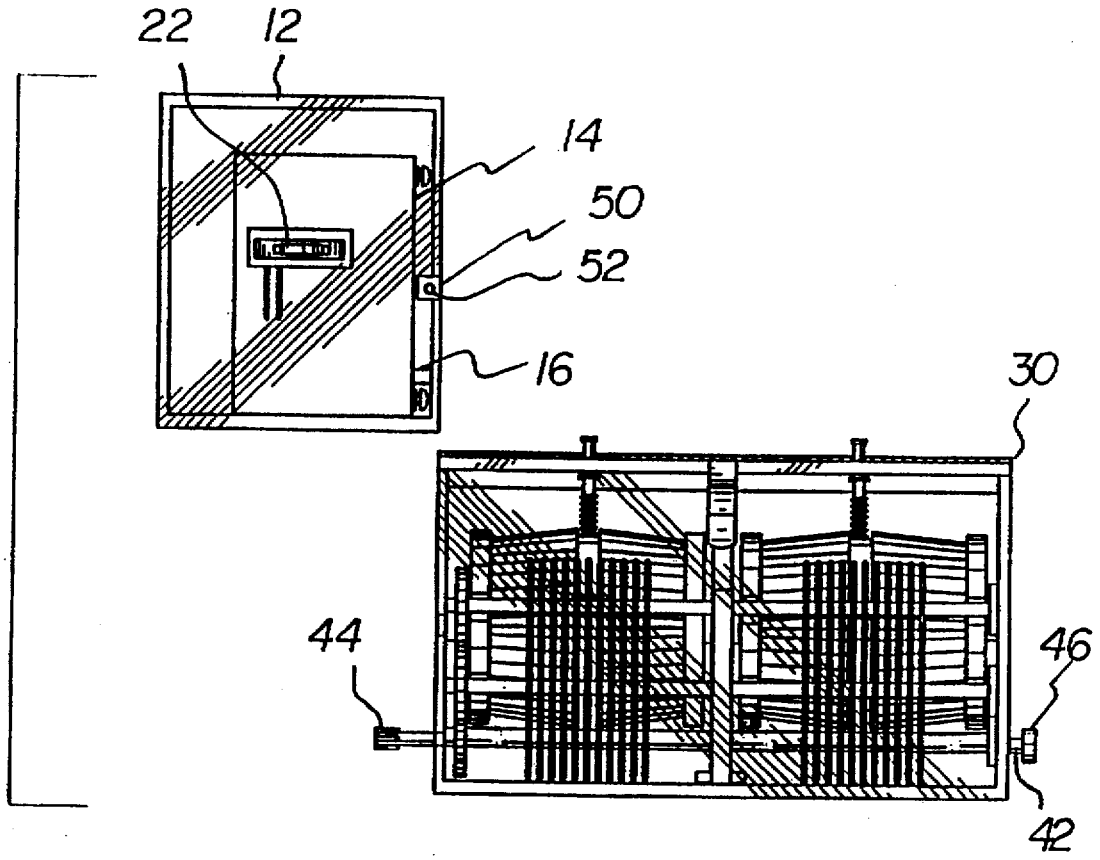
FIG. 8 is an exploded view illustrating the detachability of the motor box with respect to the cleaning unit.

More specifically, it will be noted that the system 10 of the present invention includes a motor box 12 with a rectangular configuration. As shown in FIG. 8, the motor box has an interface 14 with a female gear mechanism 16 rotatably coupled thereto and extending outwardly therefrom. The female gear mechanism is selectively driven by a motor 17 situated within the motor box. The motor box further has a rectangular lip 18 integrally formed with and extending outwardly from an entire periphery of the interface. It should be noted that the periphery extends outwardly a distance greater than that which the female gear mechanism extends. For reasons that will become apparent later, the motor box further has a pair of coupling screws 20 screwably situated in threaded apertures formed in opposite sides of the lip. A timer mechanism 22 is included as a component of the motor box for affording the driving of the female gear mechanism only for a predetermined amount of time. A lever is associated with the timer mechanism for allowing a user to govern the predetermined amount of time.

Further provided is a cleaning unit 30 with a rectangular configuration having a bottom face 32, a front face 34, a rear face 36, and a pair of end faces 38 defining a closed interior space and a top opening 40. As shown in the Figures, the bottom face has an arcuate interior surface. Further, as an option, the cleaning unit may be constructed from a transparent plastic material. The cleaning unit has a drive shaft 42 rotatably situated in apertures formed in the end faces adjacent the bottom face and the rear face thereof. O-rings may be positioned about the shaft to seal the interior space of the cleaning unit. As shown in FIG. 8, the drive shaft has a male gear mechanism 44 coupled to a first end thereof exterior of the cleaning unit. Such male gear mechanism is adapted for coupling with the female gear mechanism of the motor box. For allowing the coupling of the drive shaft with a drive shaft of another cleaning unit, a second female gear mechanism 46 is coupled to a second end of the drive shaft opposite the male gear mechanism and exterior of the cleaning unit. A drive gear 48 is coupled to the drive shaft adjacent the first end thereof and within the interior space of the cleaning unit. Note FIGS. 6. For allowing the selective coupling of the motor box and cleaning unit, a pair of tabs 50 are provided extending from a first end face of the cleaning unit from which the male gear mechanism extends. Each tab has a threaded aperture 52 formed therein whereby the cleaning unit may be situated in abutment with the motor box and the screws of the motor box threadedly coupled with the tabs for the relative securement thereof. It should be noted that the capability of separating the cleaning unit from the motor box is critical for allowing a user to clean the cleaning unit in a dishwasher. While not shown, the second end face may be equipped with a periphery and screws similar to the motor box to facilitate coupling with a second cleaning unit.

As shown in the Figures, a first brush assembly 60 is included with a plurality of vertical brushes 62 each having a dowel 64 rotatably coupled between the end faces of the cleaning unit. As can be seen in FIGS. 2–4 & 6, a gear 66 is coupled to each dowel within the cleaning unit adjacent the first end face thereof. Each dowel has a first section of bristles 68 radially extending from a portion thereof adjacent the first end face of the cleaning unit. A second section of bristles 70 radially extends from a portion of each dowel adjacent a second end face of the cleaning unit. A space is situated between the first section of bristles and the second section of bristles. As can be best seen in FIG. 6, the plurality of vertical brushes include a first vertical brush 80 centrally situated between a lower extent of the end faces with the gear thereof being in communication with the drive gear of the drive gear. Associated therewith is a second vertical brush 82 situated above the first vertical brush on a first reward side thereof. The gear of the second vertical brush resides in communication with the gear of the first vertical brush. With reference still to FIG. 6, it can be seen that a third vertical brush 84 is situated above the first vertical brush on a second forward side thereof with the gear of the third vertical brush being in communication with the gear of the first vertical brush. Still yet another vertical brush, the fourth vertical brush 86, is situated above the second and third vertical brushes between the second vertical brush and the rear face of the cleaning unit. The gear of the fourth vertical brush is maintained in communication with the gear of the second vertical brush. Finally, a fifth vertical brush 88 is situated above the second and third vertical brushes between the third vertical brush and the front face of the cleaning unit with the gear thereof being in communication with the gear of the third vertical brush. It should be noted that all of the forgoing gears of the brushes and drive shaft reside in a common plane. By this structure, the vertical brushes rotate each vertical brush in a direction opposite that of the vertical brushes adjacent thereto.

Further provided is a central vertical support plate 90 centrally coupled within the interior space of the cleaning unit, as shown in FIG. 1. Such support plate is adapted for separating the interior space into two compartments. The support plate has a top linear edge coincident with the top opening of the cleaning unit and a bottom arcuate edge abutting the bottom face of the cleaning unit. As can be seen in FIG. 1, the central vertical support plate has a pair of U-shaped cut outs 92 formed in the bottom edge thereof for allowing the passage of the dowels of the vertical brushes therethrough.

Also included is a second brush assembly 100. The second brush assembly includes a plurality of horizontal brushes 110 each with a disk 112 having a plurality of bristles extending outwardly from only one entire side thereof. As shown in FIGS. 1–4 & 8, the horizontal brushes include a first horizontal brush 114 rotatably coupled to a central extent of the first end face of the cleaning unit with the bristles thereof facing inwardly. A periphery of the disk of the first horizontal brush has a plurality of teeth 116 formed therein. Further included is a second horizontal brush 118 rotatably coupled to a central extent of the second end face of the cleaning unit. The bristles of the second horizontal brush face inwardly with a periphery of the disk thereof having a plurality of teeth formed therein. A third horizontal brush 120 is rotatably coupled to a central extent of the vertical central support plate with the bristles thereof facing toward the second horizontal brush. Similar to the prior disks, a periphery of the disk of the third horizontal brush has a plurality of teeth formed therein. Associated therewith is a fourth horizontal brush 121 rotatably coupled to the central extent of the vertical central support plate and further coupled to the third horizontal brush for coincident rotation therewith. The bristles of the fourth horizontal brush face toward the first horizontal brush. In operation, a plurality of gears 122 that are coaxially coupled along the length of the dowel of the first vertical brush are in communication with the teeth of the first, second, and third horizontal brushes. Such communication, in turn, effects rotation of the first, second, third, and fourth horizontal brushes in a similar direction of rotation. The torque of such rotation is greater than that of the vertical brushes since the diameter of the disk is greater than the gears associated with those of the drive shaft and vertical brushes.

Lastly, a lid 130 is hingably coupled to the rear face of the cleaning unit adjacent the top opening thereof. The lid has a top surface 132 and a bottom surface 134. As shown in FIG. 1, a pair of denture placement mechanism 136 are coupled to the lid. Each denture placement mechanism includes a thin rectangular plate 138 extending between a front and a rear edge of the lid. Such plates of the denture placement mechanisms further have a pair of posts 140 coupled thereto for being slidably situated through apertures formed in the lid. For precluding the separation of the denture placement mechanisms from the lid, a knob 142 is formed on a top end thereof. A plurality of springs 144 are coaxially situated about each of the posts between the bottom surface of the lid and the associated plate. By this design upon the closing of the lid, the plates reside between the horizontal brushes for maintaining dentures between the brushes during the rotation thereof. As shown in the Figures, the lid may further be equipped with a clip 150 for maintaining the lid in a closed orientation during use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for cleaning dentures comprising, in combination:

a motor box with a rectangular configuration having an interface with a female gear mechanism rotatably coupled thereto and extending outwardly therefrom, the female gear mechanism being selectively driven by a motor situated within the motor box, the motor box further having a rectangular lip integrally formed with and extending outwardly from an entire periphery of the interface wherein the periphery extends outwardly a greater distance than the female gear mechanism, the motor box further including a pair of coupling screws screwably situated in threaded apertures formed in opposite sides of the lip, the motor box further including a timer mechanism for affording the driving of the female gear mechanism only for a predetermined amount of time;

a cleaning unit with a rectangular configuration having a bottom face, a front face, a rear face, and a pair of end faces defining a closed interior space and a top opening, the cleaning unit having a drive shaft rotatably situated in apertures formed in the end faces adjacent the bottom face and the rear face of the cleaning unit, the drive shaft having a male gear mechanism coupled to a first end thereof exterior of the cleaning unit for coupling with the female gear mechanism of the motor box, a second female gear mechanism coupled to a second end of the drive shaft opposite the male gear mechanism and exterior of the cleaning unit, and a drive gear coupled to the drive shaft adjacent the first end thereof and within the interior space of the cleaning unit, the cleaning unit further having a pair of tabs extending from a first end face from which the male gear mechanism extends, each tab having a threaded aperture formed therein whereby the cleaning unit may be situated in abutment with the motor box and the screws of the motor box threadedly coupled with the tabs for the relative securement thereof;

a first brush assembly including a plurality of vertical brushes each having a dowel rotatably coupled between the end faces of the cleaning unit, a gear coupled to each dowel within the cleaning unit adjacent the first end face thereof, a first section of bristles radially extending from a portion of the associated dowel adjacent the first end face, a second section of bristles radially extending from a portion of the associated dowel adjacent a second end face of the cleaning unit with a space situated between the first section of bristles and the second section of bristles, the plurality of vertical brushes including a first vertical brush centrally situated between a lower extent of the end faces with the gear thereof being in communication with the drive gear of the drive gear, a second vertical brush situated above the first vertical brush on a first side thereof with the gear of the second vertical brush being in communication with the gear of the first vertical brush, a third vertical brush situated above the first vertical brush on a second side thereof with the gear of the third vertical brush being in communication with the gear of the first vertical brush, a fourth vertical brush situated above the second and third vertical brushes between the second vertical brush and the rear face of the cleaning unit with the gear thereof being in communication with the gear of the second vertical brush, a fifth vertical brush situated above the second and third vertical brushes between the third vertical brush and the front face of the cleaning unit with the gear thereof being in communication with the gear of the third vertical brush, whereby upon the rotation of the drive shaft, the vertical brushes rotate;

a central vertical support plate centrally coupled within the interior space of the cleaning unit for separating the interior space into two compartments, the central vertical support plate having a pair of U-shaped cut outs formed in a bottom edge thereof for allowing the passage of the dowels of the vertical brushes therethrough;

a second brush assembly including a plurality of horizontal brushes each including a disk with a plurality of bristles extending outwardly from only one entire side thereof, the horizontal brushes including a first horizontal brush rotatably coupled to a central extent of the first end face of the cleaning unit with the bristles thereof facing inwardly with a periphery of the disk of the first horizontal brush having a plurality of teeth formed therein, a second horizontal brush rotatably coupled to a central extent of the second end face of the cleaning unit with the bristles thereof facing inwardly with a periphery of the disk of the second horizontal brush having a plurality of teeth formed therein, a third horizontal brush rotatably coupled to a central extent of the vertical central support plate with the bristles thereof facing toward the second horizontal brush with a periphery of the disk of the third horizontal brush having a plurality of teeth formed therein, and a fourth horizontal brush rotatably coupled to the central extent of the vertical central support plate and further coupled to the third horizontal brush for coincident rotation therewith with the bristles thereof facing toward the first horizontal brush, wherein a plurality of gears coaxially coupled along the length of the dowel of the first vertical brush are in communication with the teeth of the first, second, and third horizontal brushes thereby effecting rotation of the first, second, third, and fourth horizontal brushes upon the rotation thereof; and a lid hingably coupled to the rear face of the cleaning unit adjacent the top opening thereof with the lid having a top surface and a bottom surface, the lid further having a pair of denture placement mechanism each including a thin rectangular plate extending between a front and a rear edge of the lid, each plate of the denture placement mechanisms further having a pair of posts coupled thereto for being slidably situated through apertures formed in the lid, each post including a knob formed on a top end thereof for precluding the separation of the denture placement mechanisms from the lid and a plurality of springs coaxially situated about each of the posts between the bottom surface of the lid and the associated plate, whereby upon the closing of the lid, the plates reside between the horizontal brushes for maintaining dentures between the brushes during the rotation thereof.

2. An apparatus for cleaning dentures comprising:

a motor box;

a cleaning unit with a rectangular configuration having a bottom face, a front face, a rear face, and a pair of end faces defining a closed interior space and a top opening, the cleaning unit having a drive shaft coupled to the motor box and rotatably situated in apertures formed in the end faces and a drive gear coupled to the drive shaft within the interior space of the cleaning unit;

a first brush assembly including a plurality of vertical brushes each having a dowel rotatably coupled between the end faces of the cleaning unit, a first gear means coupled to each dowel within the cleaning unit for communicating with the drive gear, and a plurality of bristles radially extending from the associated dowel; and a second brush assembly including a plurality of horizontal brushes each including a disk with a plurality of bristles extending outwardly therefrom and a second gear means for communicating with the drive gear.

3. An apparatus for cleaning dentures as set forth in claim 2 wherein the motor box has an interface with a female gear mechanism rotatably coupled thereto and extending outwardly therefrom, the female gear mechanism being selectively driven by a motor situated within the motor box, the drive shaft of the cleaning unit having a male gear mechanism for releasably coupling with the female gear mechanism, whereby the motor box is separateable from the cleaning unit.

4. An apparatus for cleaning dentures as set forth in claim 2 wherein the motor box further includes a timer mechanism for affording the driving of the female gear mechanism only for a predetermined amount of time.

5. An apparatus for cleaning dentures as set forth in claim 2 wherein the drive shaft has a female gear mechanism coupled to a second end of the drive shaft exterior of the cleaning unit for coupling with a second cleaning unit.

6. An apparatus for cleaning dentures as set forth in claim 2 wherein the vertical brushes include a first vertical brush centrally situated between a lower extent of the end faces, a second vertical brush situated above the first vertical brush on a first side thereof, a third vertical brush situated above the first vertical brush on a second side thereof, a fourth vertical brush situated above the second and third vertical brushes between the second vertical brush and the rear face of the cleaning unit, a fifth vertical brush situated above the second and third vertical brushes between the third vertical brush and the front face of the cleaning unit.

7. An apparatus for cleaning dentures as set forth in claim 2 and further including a central vertical support plate centrally coupled within the interior space of the cleaning unit for separating the interior space into two compartments, the central vertical support plate having a pair of U-shaped cut outs formed in a bottom edge thereof for allowing the passage of the dowels of the vertical brushes therethrough, the horizontal brushes including a first horizontal brush rotatably coupled to a central extent of the first end face of the cleaning unit with the bristles thereof facing inwardly, a second horizontal brush rotatably coupled to a central extent of the second end face of the cleaning unit with the bristles thereof facing inwardly, a third horizontal brush rotatably coupled to a central extent of the vertical central support plate with the bristles thereof facing toward the second horizontal brush, and a fourth horizontal brush rotatably coupled to the central extent of the vertical central support plate and further coupled to the third horizontal brush for coincident rotation therewith with the bristles thereof facing toward the first horizontal brush.

8. An apparatus for cleaning dentures as set forth in claim 2 and further including a lid hingably coupled to the rear face of the cleaning unit adjacent the top opening thereof with the lid having a top surface and a bottom surface, the lid further having a pair of denture placement mechanisms each including a thin rectangular plate extending downwardly between a front and a rear edge of the lid.

9. An apparatus for cleaning dentures as set forth in claim 8 wherein each plate of the denture placement mechanisms further has a pair of posts coupled thereto for being slidably situated through apertures formed in the lid, each post including a knob formed on a top end thereof for precluding the separation of the denture placement mechanisms from the lid and a plurality of springs coaxially situated about each of the posts between the bottom surface of the lid and the associated plate, whereby upon the closing of the lid, the plates reside between the horizontal brushes for maintaining dentures between the brushes during the rotation thereof.

10. An apparatus for cleaning dentures comprising:

a motor box;

a cleaning unit with a rectangular configuration having a bottom face, a front face, a rear face, and a pair of end faces defining a closed interior space and a top opening, the cleaning unit having a drive shaft coupled to the motor box and rotatably situated in apertures formed in the end faces and a drive gear coupled to the drive shaft within the interior space of the cleaning unit;

at least one brush assembly including a plurality of brushes each with gear means for communicating with the drive gear of the drive shaft; and a lid hingably coupled to the rear face of the cleaning unit adjacent the top opening thereof with the lid having a top surface and a bottom surface, the lid further having a pair of denture placement mechanisms each including a thin rectangular plate extending downwardly between a front and a rear edge of the lid.

11. An apparatus for cleaning dentures as set forth in claim 10 wherein each plate of the denture placement mechanisms further has a pair of posts coupled thereto for being slidably situated through apertures formed in the lid, each post including a knob formed on a top end thereof for precluding the separation of the denture placement mechanisms from the lid and a plurality of springs coaxially situated about each of the posts between the bottom surface of the lid and the associated plate, whereby upon the closing of the lid, the plates reside between the horizontal brushes for maintaining dentures between the brushes during the rotation thereof.

* * * * *